United States Patent [19]

Reich

[11] Patent Number: 4,627,368

[45] Date of Patent: Dec. 9, 1986

[54] EMBROIDERING STATION WITH SCHIFFLI-SHUTTLES

[75] Inventor: Rudolf Reich, Neuwied, Fed. Rep. of Germany

[73] Assignee: Aktiengesellschaft Adolph Saurer, Arbon, Switzerland

[21] Appl. No.: 789,629

[22] Filed: Oct. 21, 1985

Related U.S. Application Data

[63] Continuation-in-part of Ser. No. 408,819, Aug. 12, 1982, abandoned.

[30] Foreign Application Priority Data

Aug. 22, 1981 [DE] Fed. Rep. of Germany ..... 3133333

[51] Int. Cl.[4] ..... D05C 3/02; D05C 11/00

[52] U.S. Cl. ..... 112/83; 112/95

[58] Field of Search ..... 112/83, 84, 93, 95, 112/98, 185, 194

[56] References Cited

U.S. PATENT DOCUMENTS

| | | | |
|---|---|---|---|
| 831,046 | 9/1906 | Farmer | 112/83 |
| 876,975 | 1/1908 | Kobler | 112/95 |
| 1,017,421 | 2/1912 | Krusi | 112/83 |
| 1,017,422 | 2/1912 | Krusi | 112/83 |
| 1,200,831 | 10/1916 | Granz | 112/95 |
| 3,104,635 | 9/1963 | Bohus | 112/95 |
| 3,327,661 | 6/1967 | Reich | 112/95 |

FOREIGN PATENT DOCUMENTS

| | | |
|---|---|---|
| 308513 | 7/1973 | Austria . |
| 314955 | 5/1974 | Austria . |
| 316290 | 7/1974 | Austria . |
| 279660 | 10/1914 | Fed. Rep. of Germany . |
| 593838 | 3/1934 | Fed. Rep. of Germany . |
| 1925301 | 11/1970 | Fed. Rep. of Germany . |
| 1952307 | 2/1972 | Fed. Rep. of Germany . |

*Primary Examiner*—H. Hampton Hunter

*Attorney, Agent, or Firm*—Werner W. Kleeman

[57] ABSTRACT

For the individual, group and/or repeat change of schiffli-shuttles in embroidering machines, the schiffli-shuttle embroidering stations are shifted from centralized to decentralized shuttle stroke and vice-versa. Rotating motion of the driving shafts is converted into reciprocating motion immediately before each individual shuttle. The reciprocating motion is transmitted to entrainment rods and drive rods. The entrainment rods are rotated according to the repeat configuration so that such drive and entrainment rods are disengaged. By actuating the drive and entrainment rods, the individual schiffli-shuttles each are engaged with and disengaged from the centralized shuttle stroke. The schiffli-thread is cut, the schiffli-shuttle is arrested and the upper slider is opened or closed for group change. The empty schiffli-shuttle is removed and a loaded schiffli-shuttle inserted. In a particular embodiment for large embroidering machines with horizontal 4/4 arrangement, no conversion from centralized to decentralized shuttle stroke or drive is required.

9 Claims, 7 Drawing Figures

10
1
2
4
6
7
8
9
32
16
15
40
25
41
24
33
14
39
18
26
38
34
36
12a
I
22
23
12
12'
13
21
29
30
31
20
27
100
17
19
35
37

EMBROIDERING STATION WITH SCHIFFLI-SHUTTLES

CROSS-REFERENCE TO RELATED APPLICATION

This application is a continuation-in-part of my commonly assigned, copending U.S. application Ser. No. 06/408,819, filed Aug. 12, 1982, and entitled "Individual Embroidery Station with Horizontal Shuttles, Method for Operating said Station and Shuttle-Repeat Change", now abandoned.

BACKGROUND OF THE INVENTION

The present invention broadly relates to embroidering machines and the like and, more specifically, pertains to a new and improved method of operation and apparatus for an embroidering station having schiffli-shuttles and means for individual, group and/or repeat change of the schiffli-shuttles of embroidering, quilting and sewing machines and the like having shuttles.

Generally speaking, the method of the present invention is intended for operating shuttle machines, such as shuttle embroidering, quilting or sewing machines and the like, for selectively effecting individual, group and repeat changing of schiffli-shuttles in schiffli-shuttle embroidering stations.

The apparatus of the present invention is intended for changing shuttles of schiffli-shuttle embroidering stations in a shuttle machine, such as a shuttle embroidering, quilting or sewing machine and the like, individually, in groups or in repeats.

Individual, group and/or repeat change is an essential feature of the embroidering and/or design-making process. Whereas individual changing must be able to be carried out at any one of the embroidering stations, group and/or repeat change requires carrying out a predetermined sequence of activities while the machine is idle, which causes considerable productivity loss. In contradistinction to the needle side of an embroidering machine, the opposite or shuttle side operates with schiffli-shuttles, which in their interior space have an expendable schiffli-shuttle thread for fixing or tying the needle thread. After an average of eight hours, all schiffli-shuttles of such embroidering machines must be exchanged for newly loaded schiffli-shuttles. Depending upon the repeat configuration, the loss of production due to machine idle time, even when using a number of workers, amounts to 10% to 20% of the machine capacity. This machine idle time varies according to the design to be embroidered by the amount required for embroidering a new repeat configuration.

If, for instance, embroidering is initially performed with the least lateral spacing between two adjacent schiffli-shuttles equal to 4/4 (French inch=27.07 mm or 1.065 Imperial inches), and the design to be embroidered subsequently requires embroidering with greater design widths from needle to needle or from schiffli-shuttle to schiffli-shuttle, then the schiffli-shuttles must be removed from and reinserted in their individual guideways in the new configuration manually or by auxiliary means. Schiffli-shuttles which are not currently embroidering do not remain within the shuttle guideways, since this, from an embroidering point of view, is disadvantageous.

A needle repeat change system arranged on the needle side for activating and deactivating the needles according to the pattern or design to be embroidered is known from the German Pat. No. 1,952,307 which, however, cannot be used at the schiffli-shuttle side. At the needle as well at the schiffli-shuttle side, the needle threads as well the schiffli-shuttle threads are entrained loose and untied over the embroidery surface with a random length from one repeat area to the next. These loose threads, the so-called skip or jump threads, must be cut off and removed in a separate operation after the embroidered article has been removed from the machine, either by hand or by means of a special machine (Scherle machine). This causes additional retouching costs and an unnecessary waste of thread or yarn.

Concerning the state of the art, the following patents are considered relevant: Austrian Pat. Nos. 314,955; 308,513; 316,290; German Pat. Nos. 279,660; 593,838; and 1,925,301.

SUMMARY OF THE INVENTION

Therefore, with the foregoing in mind, it is a primary object of the present invention to provide a new and improved method and apparatus for operating shuttle machines which do not exhibit the aforementioned drawbacks and shortcomings of the prior art constructions.

Another and more specific object of the present invention is to provide a new and improved method and apparatus for a schiffli-shuttle embroidering station for all types of shuttle embroidering machines which reduces to a minimum the various operational steps that involve high expenditure in costs and personnel as well as an idle embroidering machine.

It is a further object of the present invention to decentralize the drive or stroke of the schiffli-shuttles.

Another object of the present invention is to transform rotary motion into reciprocating motion immediately before each individual schiffli-shuttle.

Another object of the present invention is to avoid any decrease in rotational speed caused by the large mass on the schiffli-shuttle side and by the drive beam or drive rail with its reciprocating shuttle stroke by means of a new shuttle drive moving smaller masses and with vertical 4/4 arrangement.

It is also an object of the present invention to avoid the above-mentioned loose or skip threads.

Finally, it is an object of the present invention to provide a schiffli-shuttle repeat change for linear embroidering machines in which the drive rail is omitted.

Yet a further significant object of the present invention aims at providing a new and improved method and apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that the schiffli-shuttle embroidering stations are selectively shifted from the centralized into the decentralized schiffli-shuttle stroke or drive and vice-versa while the rotary motion of the drive shafts is transformed into reciprocating motion immediately before each individual schiffli-shuttle, which reciprocating motion is transferred to the entrainment coupling and the shuttle driver. The entrainment coupling is rotated according to the repeat configuration, for instance by selecting means, and thus is released from engagement with the shuttle driver. Conjointly with actuation of the shuttle driver and entrainment coupling, each individual schiffli-shuttle is shifted into or out of engagement with the centralized stroke or drive, the thread is cut, the schiffli-shuttle is locked or arrested and the upper slider for group or repeat change is opened or closed, the empty schiffli-shuttle is removed and a new, loaded schiffli-shuttle is inserted.

For carrying through this method, means are proposed which are characterized by drive apparatus or means for transforming the rotary motion of the centralized drive into reciprocating motion of a drive element or tab. A rotatable guide means or guide rod which carries an entrainment coupling engages this drive member or tab on the one hand and the shuttle driver on the other hand. This rotatable guide means removes the upper slider from the schiffli-shuttle guideway and actuates the thread cutter. Selecting means determine the repeat size and rotate conjointly with the entrainment coupling. Group change means remove the empty schiffli-shuttles from the shuttle guideway and insert the new, loaded schiffli-shuttles into the shuttle guideway.

In other words, the apparatus of the present invention is manifested by the features that it comprises: at least one schiffli-shuttle guideway fixed to a frame member of the machine to extend in a predetermined direction of extent; a schiffli-shuttle guided in the schiffli-shuttle guideway; stationary longitudinal guide means fixed to the frame member and extending substantially parallel to the predetermined direction of extent of the schiffli-shuttle guideway; a shuttle driver translatably guided by the stationary longitudinal guide means and provided with coupling means; barrier means mounted in the shuttle driver and extending substantially transversely into the schiffli-shuttle guideway for entraining and restraining the schiffli-shuttle in the schiffli-shuttle guideway; rotatable longitudinal guide means journaled in the frame member and extending substantially parallel to the stationary longitudinal guide means; an entrainment coupling translatably guided by the rotatable longitudinal guide means and provided with at least one entrainment means; means for preventing rotation of the entrainment coupling in relation to the rotatable longitudinal guide means; the rotatable longitudinal guide means having a first angular orientation in which the coupling means engages the entrainment means and a second angular orientation in which the coupling means disengages from the entrainment means; a reciprocating drive member engaging the entrainment means for transmitting drive motion through the entrainment coupling and the shuttle driver to the schiffli-shuttle; and control means for selectively rotating the rotatable longitudinal guide means between the first angular orientation and the second angular orientation.

With this invention, the amount of work-load and time required for group changing, for determining the repeat configuration or for the repeat change can be reduced to 1% of that for known machines. Furthermore, the central drive of the schiffli-shuttles hitherto employed can be transformed into a decentralized drive in which transformation of rotary motion into reciprocating motion is performed immediately before each schiffli-shuttle in order to preserve the rotary motion of the drive shafts as long as possible. In this manner, the inertia of the heavy drive beam with all of its accessories, such as supports with shafts, linkages and the like, which reduces rotary speed by 5% or 10%, is decreased by arranging an oscillating drive shortly before each embroidering station and therefore obtains an increase in rotary speed. This is also true when a drive rail is used instead of a drive beam.

This invention can be used for various types of embroidering machines with circular shuttles or longitudinal or linear shuttles, so that a wide field of use, extremely economic operation and, analogous to the needle side, an increase in the spectrum of feasible designs can be obtained.

According to hitherto known methods, the change of schiffli-shuttles is performed in such a manner that the operator, after switching off the embroidering machine, moves the schiffli-shuttle side of the machine into top dead center at low speed, and then walks along the machine and cuts off the schiffli-shuttle threads close to the embroidery by means of scissors or a knife. With a slide opener, all upper drivers or sliders are withdrawn from their working position. The operator again walks along the machine and removes groups of, for instance, 9 or 11 empty schiffli-shuttles from the machine and collects them for being re-filled. This removal is done by means of schiffli-shuttle lifting mechanisms or tools. Then the operator walks once more along the machine with a shuttle inserting mechanism or tool containing about 34 loaded shuttles, which are inserted into the empty shuttle guideways by pushing a button. Finally, the operator walks along the machine a last time and presses the withdrawn upper drivers or sliders into their working position by means of a shuttle driver closer. This terminates the conventional group change.

In the method and apparatus of the present invention, these steps are performed automatically without requiring an operator. The method can be used for manual operation of any schiffli-shuttle embroidery station, for central manual operation of the entire machine or automatically by means of a central data carrier. The only difference is in the partial or complete sequence of operations required by individual changing, if, for instance, problems should arise with the schiffli-shuttle thread on any schiffli-shuttle and require a change of the corresponding schiffli-shuttle in the embroidering machine running at low speed or if, as a further example, only a group change is required with idling shuttles, and, as a final example, if during reinsertion after group change removal a repeat change must be carried out within the group change in the framework of the desired repeat configuration on the schiffli-shuttle side for inspection purposes.

The following operational steps according to the invention are valid for a simultaneous group and repeat change of the schiffli-shuttles. If only an individual change or a group change is required, the operational sequence is correspondingly reduced.

It is determined manually (for individual changing) or by selecting means which of the schiffli-shuttles within the full complement of the machine are to be changed. For individual changing, the change is made with the embroidering machine running at low speed. In group changing of the entire machine, the operator actuates the push button "group change only" or "group and repeat change". The machine shuts down, in any case, and the positioning means position the schiffli-shuttles at top dead center of the schiffli-shuttle guideway, because in this position the schiffli-shuttles to be changed have their greatest withdrawal length of about 50 mm requisite for picking-up or recommencing embroidering or, alternatively, the positioning means shifts the frame in such a manner that the pick-up or embroidering resumption length is adequate, for instance for small schiffli-shuttle sizes. The selecting means, with the repeat configuration of the schiffli-shuttle side preset, makes a backward or reverse movement, laterally or vertically according to the construction, which initiates shifting the schiffli-shuttle side out of engagement with the centralized drive. Simultaneously, the severing or cutting device is forced to sever the schiffli-shuttle thread. Even in designs with repeat change, no loose threads are obtained. The upper driver or slider is swung or pivoted upwardly to the same extent by means of the entrainment coupling, so that the schiffli-shuttle which is to be changed can be taken out of the guideway upwardly. The lower driver remains unchanged and arrests or retains the schiffli-shuttle.

A limit switch is mounted at a so-called pilot schiffli-shuttle embroidering station, a term which will be explained hereinbelow. This limit switch actuates a swivel arm for group ejection. In a vertically arrayed arrangement of schiffli-shuttles, this swivel arm either is provided with a magnetic bar or with gripping means for engaging the schiffli-shuttle. If at this time the shuttle configuration is to be changed, then the schiffli-shuttle which is to embroider next must be newly determined. The selection means cancels the former repeat configuration and determines the new repeat configuration and the corresponding closing of the upper driver or slider as well determining which upper drivers or sliders must open. Now, the appropriate instructions (from the pilot schiffli-shuttle embroidering station) are transmitted to the shuttle insertion means. The latter engages reserve schiffli-shuttles prepared in containers commonly arrayed within a laterally translatable rack in the channel member by the operator in correspondence to the repeat configuration and then moves laterally to the empty schiffli-shuttle guideway. The individual containers are formed in an accordion-like manner for bridging the lateral difference and press the new schiffli-shuttle into the shuttle guideway at the end. Thus, the new shuttle is retained and the containers within the rack return to their idle position.

In a horizontally arrayed arrangement of the schiffli-shuttle modules or sections, the schiffli-shuttles are inserted similarly by arranging a bar or rail above or laterally adjacent to the drive shaft on the module or section frame. Conventional schiffli-shuttle insertion means holding the prepared reserve shuttles are translated individually or jointly along this bar or rail to the opened shuttle guideway. A bottom rail or a grill or grid rod at the lower part of the schiffli-shuttle insertion means is pressed aside by the pilot embroidering rotation.

After completing the forementioned functions involved in the interrelated and freely selectable group change only or in group and repeat change of the schiffli-shuttles, the pilot embroidering station initiates operation of the entire embroidering machine for the new embroidering process. The corresponding sequence of operations is automatically performed within about one minute. The particular structural embodiment is chosen by the client, whether fully or partially automatic and in dependence of the foreseen application of the corresponding embroidering machine, according to whether or not designs entailing repeat changing are to be embroidered.

The pilot schiffli-shuttle embroidering station can be provided with conventional positioning means or can be composed of electronic units. For instance, it can synchronize the motion sequence of the shuttle side with that of the needle side in the form of a control processor. The selecting means can be actuated manually, electrically, pneumatically or in other analogous manner.

The repeat change is made according to the repeat configuration. If, for instance, only every second or third shuttle is to embroider, the non-embroidering shuttles must be removed from the machine. According to this invention, repeat change is performed automatically by the selecting means, which contains all repeat sizes or spacings from 4/4 to 48/4 or more in constant or variable sequence. The time required for repeat change is about 20 to 30 seconds.

Thus, the method and apparatus of the invention provide an increase of productivity by considerably reducing machine idle time, eliminating labor, partially eliminating job planning and tooling for at least some of the operational steps, by saving a considerable amount of schiffli-shuttle yarn or thread, by shorter loading times, by eliminating the cutting of loose or skip threads and provide a 5% to 10% higher rotary speed by omitting large machine masses and by delaying conversion of rotary motion to reciprocal motion until immediately before each schiffli-shuttle. This invention can be used for any type of existing embroidering machines which are to be rebuilt as well as for all new embroidering machines comprising prefabricated sections or modules. The previous embroidering utensils are removed and the new ones are grouped in sections or modules and are installed in the existing machine by the section or module manufacturer.

Simultaneously with the repeat and/or group change and the selection of a 4/4 schiffli-shuttle embroidering station, the entire drive means and 4/4 individual drives are improved by preserving the rotation of the main drive shaft and postponing its transformation or conversion into the amount of reciprocating motion required by the needle to a location within the schiffli-shuttle embroidering station or in the schiffli-shuttle section or module. In vertically arrayed arrangements, each schiffli-shuttle section drive shaft is provided with a crank and connecting rod or eccentric and with transmission members which transform the rotary motion into a reciprocating or oscillating motion. Transmission of this reciprocating motion to the 4/4 schiffli-shuttle embroidering stations can, for instance, be performed by an arrangement of serrated pulleys and serrated or toothed flat belts. Each belt operates or drives two embroidering stations, either of which can be disengaged at will. If, alternatively, the conventional drive beam hitherto employed is retained, such eccentric arrangements can be dispensed with. The reciprocating motion then can be generated by a reversible electric motor. Furthermore, the mechanical operation of the needles in a pilot schiffli-shuttle embroidering station can be sensed electronically and can be transmitted to one or to a plurality of schiffli-shuttle sections or modules or to the entire machine by appropriate transverse connections, serrated or toothed flat belts, shafts with bevel gears, angle drives or the like for imparting a corresponding motion to the schiffli-shuttles. Each section or module can be provided with its own reversing motor. A wide variety of designs can therefore be realized by engaging and disengaging individual sections manually or under program control. In conjunction with the movement of the embroidering frame in lateral increments, embroidery pattern widths of more than 48/4 can be obtained. For instance, at a spacing of 96/4, the next section of 48/4 simply is disengaged and left idle. The pattern or design is therefore always widened in steps or increments of 4/4 (French inch).

All contemporary linear embroidering machines have means for moving the rear carriage with the embroidering machine idling for clamping and releasing the fabric. This feature is exploited according to the present invention for the repeat change of the schiffli-shuttles. A supporting rack is combined with the rear carriage of the embroidering machines, for instance by means of supports or brackets. This rack carries the control means, for instance a cylinder or drum with protrusions or recesses on its surface, a switching plate or the like, and has a guide for accommodating such control means.

For determining the repeat of active and inactive schiffli-shuttles, this supporting rack is translated or pivoted. The schiffli-shuttle guideways remain in their working position during determination of the repeat program. Subsequent thereto, the control means are appropriately adjusted in height manually or automatically be means of grid adjustments within the supporting rack. Subsequent to deciding which repeat line or row in the embroidering height the corresponding schiffli-shuttle is to deactivate, the supporting rack is moved axially to the actuation position and rotates the actuating lever by a predetermined amount, which determines all subsequent operational steps (disengagement from the central stroke, opening the upper driver or slider, positioning the schiffli-shuttles, cutting the schiffli-shuttle thread). These steps are carried out with the embroidering machine idle and at top dead center of the stroke of schiffli-shuttles.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 2, 3:
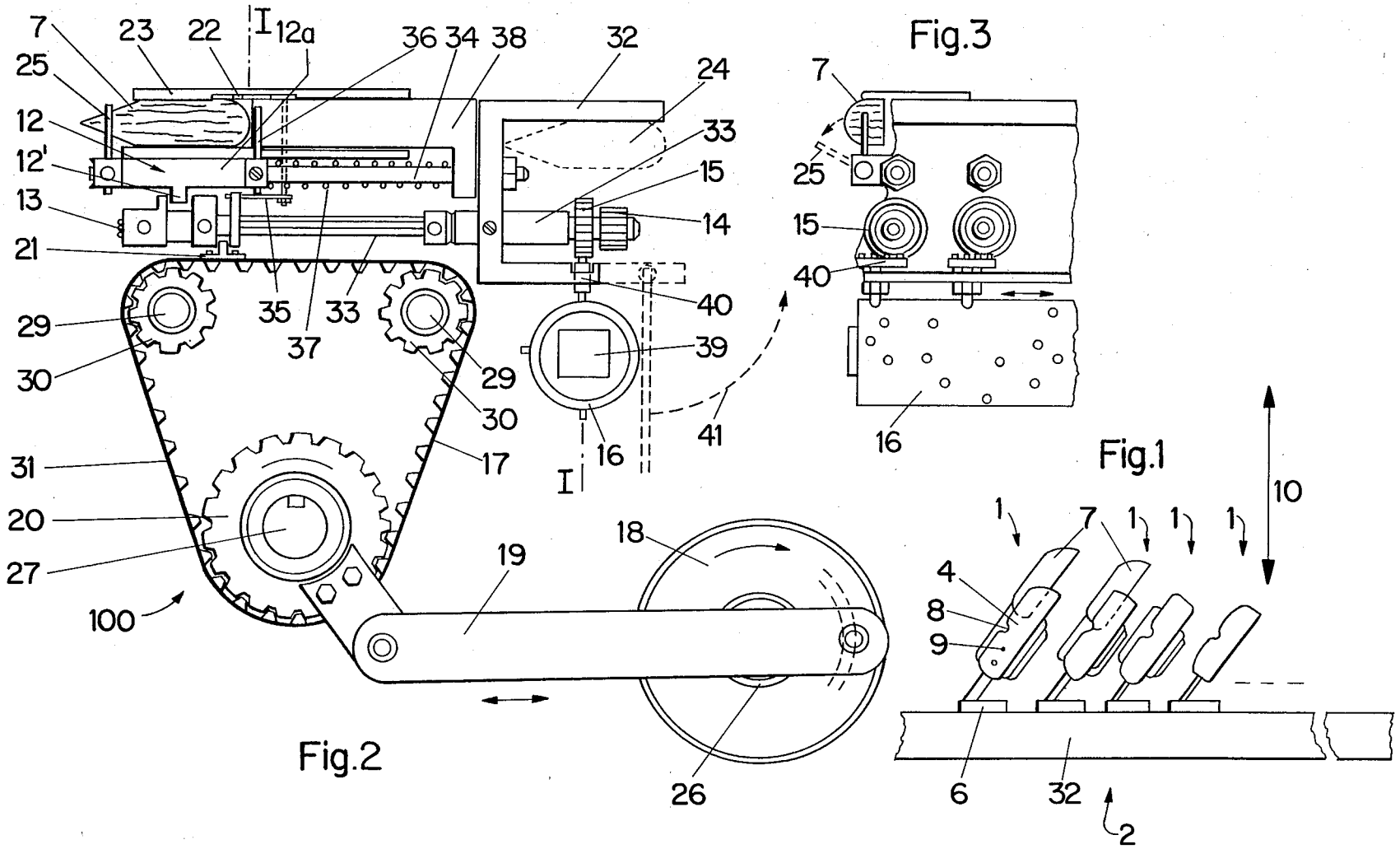
FIG. 1 is a schematic view of a horizontally arrayed arrangement of schiffli-shuttle sections or modules within an embroidering machine.
FIG. 2 is a schematic overall representation of the system according to the present invention in side elevation in relation to FIG. 1.
FIG. 3 is a cross-section taken along line I—I of FIG. 2.

Describing now the drawings, it is to be understood that to simplify the showing thereof only enough of the structure of the apparatus of the invention has been illustrated therein as is needed to enable one skilled in the art to readily understand the underlying principles and concepts of this invention. Turning attention now specifically to FIG. 1 of the drawings, the apparatus illustrated therein by way of example and not limitation and employed to realize the method as hereinbefore described will be seen to comprise a horizontal arrangement or array 2 of adjacent 4/4 embroidering stations 1 suitable for linear embroidering machines of 10, 15, 21 and 25 yards. Above the embroidering stations 1 there is a free space 10 corresponding to the height of the area to be embroidered. These embroidering stations 1 may be grouped into sections or modules, which permits employing a prefabricated system of units which can be modified at will, even at a later date.

In the horizontal arrangement or section 2 shuttle guideways 4 which extend in an upwardly inclined direction and in mutual spaced relationship are provided for the embroidering stations 1. These shuttle guideways 4 are connected by mountings or guides 6 with the corresponding sections 2. The supports or beams 32 of the sections 2 are formed from channels or U-profiles. Schiffli-shuttles 7 are arranged within the shuttle guideways 4. The reference numeral 8 designates a needle channel, 9 a piercer or bore channel, and 10 the free space.

Each shuttle guideway 4 with its schiffli-shuttle 7 has a device 100 according to FIG. 2. All shuttle guideways 4 are interchangeable and can be modified at will.

The device 100 is arranged in front of the shuttle guideways 4 as shown in FIG. 2 in side view. In contradistinction to the needle section, the schiffli-shuttle guideways 4 are always oriented in the same direction due to the fixed spacing of the needle and piercer or bore channels 8 and 9 provided in the schiffli-shuttle guideways 4. For the needle side, section embroidery heads can be manufactured which alternate in mirror image, since only a needle is provided. This is not possible on the shuttle side.

According to FIG. 2 a longitudinal schiffli-shuttle 7 is shown in its advanced or outermost position, where it is restrained by a shuttle driver or slider 12 biased by a compression spring 37. The shuttle driver or slider 12, which comprises a pivotable sleeve translatable on a drive rod or stationary longitudinal guide means 34 is connected by means of a protrusion or entrainment means 12 with a driver or entrainment coupling 13 (shown in the coupled position). The entrainment coupling 13 is mounted on a coupling rod or rotatable longitudinal guide means 33, which can be rotated by a handle or knob 14. The coupling rod or rotatable longitudinal guide means 33 is provided with a rack and pinion drive 15, 40 for the embroidery program (controlled with or without data carrier for centralized machine operation). The rack and pinion drive 15, 40 engages a pin roller or control drum 16. A serrated or toothed belt drive 17 obtains its drive from a schiffli-shuttle section shaft 26 by means of a crank plate 18 with adjustable stroke, a connecting rod 19 and a serrated belt pinion or pulley 20. The serrated belt 17 is provided with a coupling tab or drive member 21 which engages the entrainment coupling 13 on the coupling rod or rotatable longitudinal guide means 33. A thread cutter 22 and a schiffli-shuttle guideway stitch plate 23 for the schiffli-shuttle 7 are also provided. A substitute or reserve schiffli-shuttle 24 is shown in its rest or idle position. The schiffli-shuttle 7 is restrained between a lower shuttle driver 36 mounted to the driver bar or stationary longitudinal guide means 34 and the pivotable upper shuttle driver or slider 25. The lower shuttle driver 36 is mounted on a translatable adjustment collar or ring 12*a* and the upper shuttle driver or slider 25 is axially operable on the rotatable shuttle driver 12. The lower shuttle driver 36 and the upper shuttle driver or slider 25 are thus independent from each other and are moveable on the driver bar or stationary longitudinal guide means 34. The shuttle driver 12 is rotatable and is driven by the entrainment coupling 33. The compression spring 37 produces a constant counterpressure.

The coupling tab or reciprocating drive member 21 is driven by the shuttle section shaft 26 through a schiffli-shuttle embroidering station shaft 27, which is provided with a pinion or serrated pulley 20. Two countershafts 29 move together therewith and have small pinions or serrated pulleys 30. A toothed or serrated belt 31 passes over the pinions or serrated pulleys 20 and 30.

A channel or U-profile 32 carries the shuttle support 6, the shuttle driver rod or stationary longitudinal guide means 34 and the coupling rod or stationary longitudinal guide means 33. The shuttle driver rod or stationary longitudinal guide means 34 carries the shuttle driver sleeve 12 and a knife or shear actuator 35, and the shuttle driver sleeve 12 holds the lower shuttle driver 36. The knife or shear actuator 35 extends past the shuttle driver rod or stationary longitudinal guide means 34 and is rotatably mounted within a bore of the schiffli-shuttle guideway 38.

A compression spring 37 is mounted on the shuttle driver rod or stationary longitudinal guide means 34 between the U-profile or channel 32 and the shuttle driver sleeve 12. The reference numeral 39 designates a driving mechanism or shaft for a selecting or control means 16. The U-profile or channel 32 translatably accommodates individual rack gears 40, which engage the selecting or control means or pin roller 16. The reference numeral 41 designates a group change device.

In order to explain the entire system in relation to FIG. 2, the individual groups of elements of the apparatus of the present invention will be described as follows:

Drive:

The shuttle section drive shaft 26 is rotated by the central drive means of the machine through the eccentric means or crank 18 and the connecting rod 19 or, alternatively, by a reversible electric motor. In the case of central drive, an eccentric means or crank disc 18 with a connecting rod 19 is provided on the shuttle section drive shaft 26. The connecting rod 19 is adjustably journaled on the eccentric means or crank disc 18 in relation to the required needle stroke so that the axial schiffli-shuttle stroke can be predetermined; the connecting rod 19 is eccentrically mounted to the crank disc 18 and transforms the rotary motion of the main drive shaft into a reciprocating motion corresponding to the shuttle stroke.

A shuttle shaft 27 associated with each embroidering station 1 is provided with flat toothed or serrated pulleys or pulley wheels 20. The pulleys 20 are preferably spaced 8/4, i.e. at twice the schiffli-shuttle spacing, to reduce their number. Stable flat toothed or serrated drive belts 31 are guided on these pulleys 20. Two auxiliary or idler shafts 29 are arranged in spaced relationship to the shuttle shaft 27 to guide the serrated drive belt 31 in a roughly triangular path. Between the two auxiliary shafts 29 provided with toothed or serrated pulleys or idler pulleys 30, a follower tab or reciprocating drive member 21 is provided which is sufficiently wide for simultaneously operating or driving two or more individual entrainment couplings 13 spaced normally at 4/4 so that either both such entrainment couplings 13 or only one can be operated or driven, whereas the other, by rotating the rotatable longitudinal guide member 33, is disengaged from the machine drive, either manually or under program control. This allows, for the first time in the embroidering field, providing complete assembly sections or modules ready for installation in new embroidering machines or, alternatively, for rebuilding existing embroidering machines at the shuttle side.

The not particularly shown reversible motor is directly connected with a pilot embroidering station at the needle side and transfers the sequence of motion at the needle side with the corresponding sequence of shuttle motion to the corresponding schiffli-shuttles. In embroidering machines having many shuttle sections at the schiffli-shuttle side, this results in additional possibilities for new pattern techniques by means of engagement and disengagement during the embroidering process in cooperation with the needle side.

Drive for schiffli-shuttle embroidering stations:

On the shaft 27, the flat toothed or serrated pulleys 20 are provided preferably at 8/4 spacing as previously mentioned. Two idler shafts 29 and associated toothed or serrated idler pulleys cooperate with the schiffli-shuttle shaft 27. All three toothed or serrated pulleys 20 and 30 are provided with an endless flat toothed or serrated drive belt 31 so that by means of the belt 31 all serrated pulleys move in forward and reverse with the same stroke. On belt 31 of the belt drive 17, which is actuated in a reciprocating manner by the schiffli-shuttle shaft 27, a follower tab or reciprocating drive member 21 is provided which is of such width that it can simultaneously operate, for instance, two schiffli-shuttle embroidering stations spaced at 4/4 within the 8/4 schiffli-shuttle spacing.

Coupling rod:

Within the U-profile or channel 32, a grooved rotatable coupling rod or longitudinal guide means 33 is journaled. The driver clutch or entrainment coupling 13 is translatably fixed against rotation at the left end of this rotatable longitudinal guide means 33, as seen in FIG. 2. The entrainment coupling 13 is formed as a follower at both sides and is in direct engagement with the follower tab or reciprocating drive member 21 as well as in selectable engagement with the shuttle driver sleeve 12. If the coupling rod or rotatable longitudinal guide means 33 is rotated, the direct driving engagement with the follower cam or reciprocating drive member 21 is maintained; the shuttle driver sleeve 12 is engaged to and disengaged from the centralized machine stroke or drive. At the same time, the coupling rod or rotatable longitudinal guide means 33 rotates the shuttle driver sleeve 12 and moves upper shuttle driver or slider 25 over the distance required for releasing the schiffli-shuttles 7 for removing them from the schiffli-shuttle guideway 38. In the opposite case, the upper shuttle driver or slider 25 is moved in front of the schiffli-shuttle 7 in its operating position. Simultaneously, the coupling rod or rotatable longitudinal guide means 33, when rotated, strikes the shear actuating member 35 which, when rotated, actuates the shear or thread cutter 22. For manual operation at any embroidering station, the other end of the coupling rod or rotatable longitudinal guide means 33 is provided with a grip or hand knob 14. For program-controlled operation of the repeat configuration, or for operation by data carrier within the repeat change, the rack and pinion drive 15 is arranged in direct correspondence with the selection control device constructed as a pin roll or cam drum 16.

Driver rod:

The driver rod or stationary longitudinal guide means 34 is mounted at the shuttle guideway foot and guides the shuttle driver sleeve 12 carrying the lower and upper shuttle drivers 25 and 36. If the barrier formed by these shuttle drivers 25 and 36 is open, then the lower driver 36 arrests the inactive schiffli-shuttle 7 against falling back into the schiffli-shuttle guideway 38, whereas upper shuttle driver or slider 25 maintains such barrier open to such an extent that the schiffli-shuttle 7 to be exchanged can be extracted without difficulties. In order to prevent change of the position of the shuttle driver sleeve 12 by oscillations within the machine in the idle state, the driver bar or stationary longitudinal guide means 34 is provided with the compression spring 37, which exerts a continuous pressure against the shuttle driver sleeve 12.

Schiffli-shuttle guideway:

A conventional 4/4 shuttle embroidering station 38 with a shear or thread cutting means 22 is used unmodified; the toothed or serrated pulleys 20 and 30 merely require adaptation to the particular inclination of the schiffli-shuttle guideways 38 in the module or section arrangement as shown in FIG. 1.

Selection means:

Selection or control means are provided, such as for instance the pin roller or cam drum 16. Such a pin roller or cam drum 16 allows arranging practically any number of control elements determining the requisite functions at the periphery of the roller or drum 16 in a minimum of space. Each 4/4 embroidering station is controlled by a ring with actuation pins, each of which ring is mounted on a square drive shaft 39. The selection or control means 16 may be actuated by hand, for instance by means of a ratchet, or may be program-controlled, for instance by a stepping motor. Each ring has a region free of pins and of a predetermined width so that, when the selection or control means 16 is conventionally translated, the repeat configuration required by the embroidering pattern is selected.

Each ring has one or several actuation pins, cams or the like at the same position so that by rotating the selection or control means 16 all embroidering stations are engaged in the embroidering process. If every second or third schiffli-shuttle embroidering station is to embroider, these pins, cams or the like are correspondingly spaced.

Cancellation of the active embroidering stations and determination of new embroidering stations is obtained by rotating the pin roller 16 defining the selection or control means 16 in the opposite rotational direction. As soon as selection or control means 16 determines the new repeat value, it engages the tooth 40 provided at the U-profile or channel 32 with the actuation pins or cams, rotates the rack and pinion drive pinion 15 on the coupling rod or rotatable longitudinal guide means 33 and either executes the described functions or cancels them when rotated the other direction.

Such selection or control means 16 can also be appropriately adapted to all processes at the needle side, for instance piercing or boring, thread clamping, front shearing or thread cutting, using small and large thread guides et cetera.

FIG. 2 shows merely four different repeat combinations with the pin roller 16; by increasing the diameter of the pin roller 16, these possibilities can be increased considerably.

An analogous adaptation from the schiffli-shuttle side to the needle side is possible on the same principle. Rings with a width of 4/4 are used in juxtaposition. The rings can be combined according to the dimensions of the section and the section ends can be screwed together at both sides. Instead of the described pin roller 16, for instance an axially moveable selection or control plate can, for instance, be used (cf. FIG. 4).

Group change:

Group changing of the shuttles within the framework of the repeat configuration is made manually from section to section or centrally unified and/or programmed by means of, for instance, a magnetic rail arranged between two arms defining conjointly therewith the group change device 41. This magnetic rail is pivoted into the free space 10 adjacent the section in the height of the embroidery field. Shortly before the end of the pivoting motion, those schiffli-shuttles 7 which have been drawn into the magnetic field of the rail from the opened upper driver or slider 25 are attracted by the magnetic rail and are removed from the embroidering machine or from the schiffli-shuttle guideways 38 in groups in each section. Means are provided to prevent those schiffli-shuttles which are being removed from colliding with other schiffli-shuttles, such as by restricting the magnetic field. Schiffli-shuttles which are not to be removed remain in place in spite of the magnetic field due to the closed barrier formed by the upper shuttle driver or slider 25.

Therefore, with practically no extensive equipment expenditure, all schiffli-shuttle embroidering stations of a shuttle embroidering machine can be changed simultaneously independently of size. By pivoting a shaft mounted at the channel or U-profile 32 and having one arm each at the leg and the head end per section between which a continuous rail with magnets is arranged, the magnetic rail is pivoted manually or all sections are pivoted under centralized program control into the free space 10 in which no machine parts are provided. As soon as the magnetic rail with its magnetic field has reached the schiffli-shuttle 7 released by the upper shuttle driver or slider 25, the schiffli-shuttle 7 is drawn into a cage provided at the magnetic rail and is pressed against the magnetic rail. Return means known per se now move the magnetic rail with the adhering, ejected, empty schiffli-shuttles into the starting position. As soon as the machine is running again, the operator collects the ejected schiffli-shuttles 7 into a container.

Simultaneously with the described pivoting movement, a reserve shuttle rail is moved laterally; this reserve shuttle rail is provided within the interior of the channel or U-shaped profile 32 and has extensible small receptacles for the reserve schiffli-shuttles 7 in 4/4 spacing. The reserve schiffli-shuttles 7 are inserted into these receptacles by the operator during the monitoring period between two group changes. With the pivoting movement of the magnetic rail, the reserve shuttle rail moves simultaneously laterally into the free space 10 up to the guide path of the adjacent schiffli-shuttle guideway 38 influenced by the magnetic rail in the same plane. The reserve schiffli-shuttle 7 is therefore now situated in the guide path of the adjacent schiffli-shuttle guideway 38.

An end switch in one pilot section closes the barrier formed by the upper driver or slider 25 via the positioning means. Thus, the reserve schiffli-shuttle is trapped. The reserve shuttle rail returns to the starting position simultaneously with the magnetic rail and moves the extensible shuttle receptacles together in 4/4 spacing. These receptacles now can be filled with new reserve shuttles. Instead of a magnetic rail, known shuttle lifting means or shuttle lifting tools can be employed to constitute the group change device 41 if appropriately designed or modified.

If the embroidering pattern requires a schiffli-shuttle repeat change, such change is effected by the selection or control means 16 through the positioning means between opening shuttle barrier and closing upper driver barrier. The magnetic rail and the reserve schiffli-shuttle rail operate in 4/4 spacing, but can only change those schiffli-shuttles 7 which the selection or control means 16 release or hold ready by means of the barrier formed by the upper shuttle driver or slider 25.

According to the sort of embroidering machine, type or size, the 4/4 schiffli-shuttle embroidering stations are combined and assembled ready for installation and are inserted into the embroidery machine traverse base racks and connected to the main drive. An embroidery touch-up machine with, for instance, ten different colors and needle diameters, which may be required individually for touch-up embroidering has a different section or module size than a multi-head automatic embroidering machine of 2000 mm width or a 15 yard wide embroidering machine with standardized sections or modules of one yarn width.

Schiffli-shuttle insertion:

Shuttle insertion in accordion or bellows-like extensible receptacles is effected within the channels or U-profiles 32; the group change device or means 41 actuates not particularly shown elements which move the reserve schiffli-shuttles 24 by means of a not particularly shown rail with extendible reserve shuttle supports arranged in 4/4 spacing to adjacent section schiffli-shuttle guideways 38 provided in the same plane, and which arrange them on the guide path of the schiffli-shuttle guideway 38. If the barrier formed by the upper shuttle driver or slider is closed under program control, the reserve schiffli-shuttle 24 cannot participate in the reverse motion of the emptied reserve shuttle. This reverse motion of the rail is made synchronously with operation of the ejector or group change device 41.

A not particularly shown rail in the section rack above the section shaft 26 is provided within the free space 10 along the machine on which an insertion mechanism can be translated to a free schiffli-shuttle guideway. A limit switch releases the moveable bottom at the point of insertion according to the required repeat configurations or according to the arrangement of the schiffli-shuttles 7, and the schiffli-shuttles 7 fall past the open upper shuttle driver or slider 25 into the shuttle guideway 38. The stationary lower shuttle driver 36 catches the new schiffli-shuttles 7 and prevents their falling through.

Within the long group-changing interval until the next set is changed, new reserve schiffli-shuttles 24 can be inserted or loaded into the supports by hand.

The apparatus according to the present invention can be adapted to various types of embroidering machines and to the corresponding applications in view of the system of assembly of prefabricated machine parts or modules. An embroidery touch-up machine, for instance, merely requires one embroidering station, but must have more than one available due to the multiplicity of different colors required; on the other hand, a multi-needle embroidering machine for producing embroidery products may have far more than 1000 embroidering stations operating simultaneously.

Figure 4A:
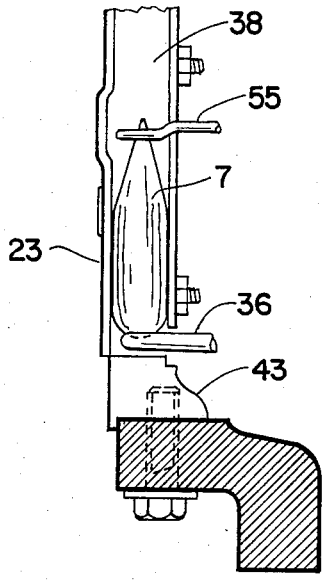
FIG. 4*a* is a schematic representation of a schiffli-shuttle and schiffli-shuttle guideway corresponding to FIG. 1.
Figure 4B:
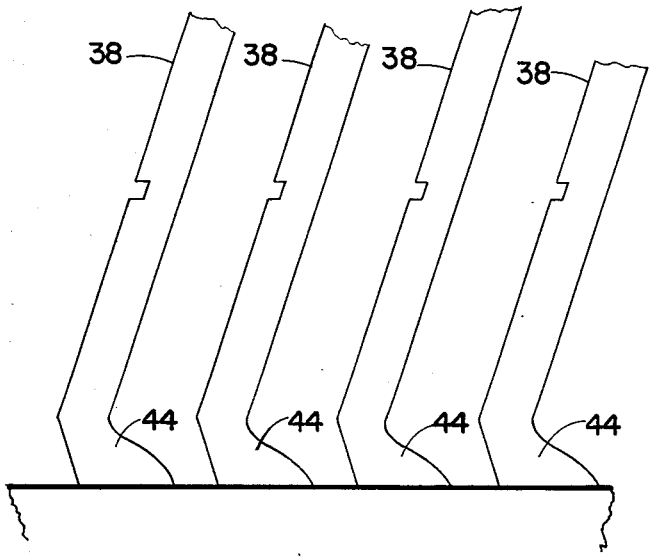
FIG. 4*b* schematically shows an arrangement of schiffli-shuttle guideways in a frontal view of the embroidering machine.
Figure 4C:
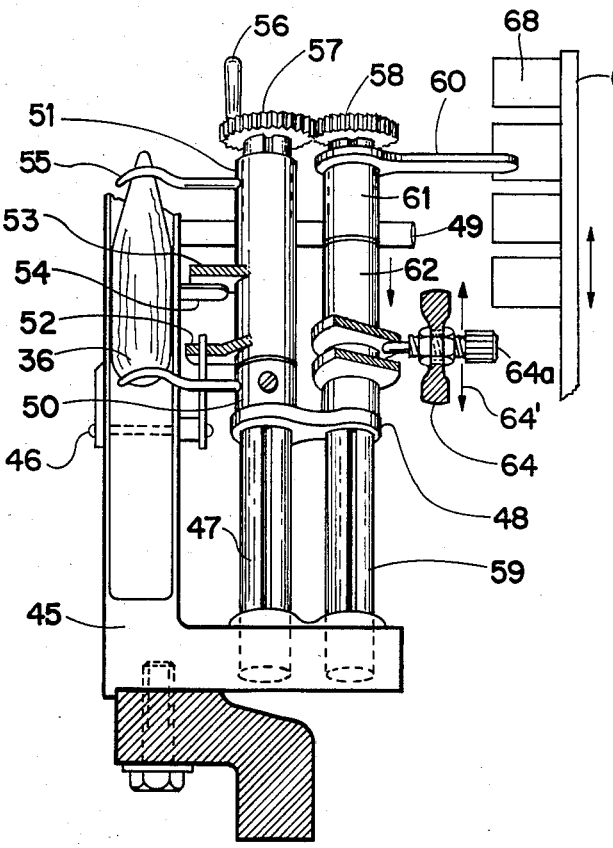
FIG. 4*c* schematically shows a side view corresponding to that of FIG. 4*a* and including engagement and actuation means for the schiffli-shuttle.
Figure 4E:
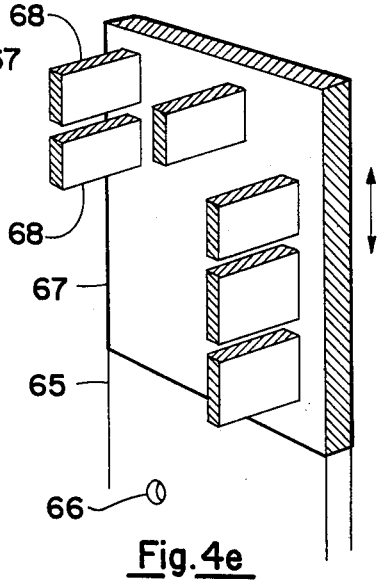
FIG. 4*d* schematically shows a selection control means for determining the repeat configuration of the schiffli-shuttle.
Figure 4D:
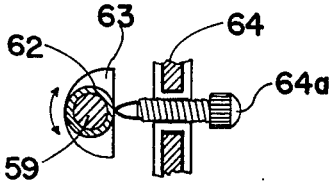

In the schiffli-shuttle repeat changing apparatus according to FIG. 4*a*, the reference numeral 43 designates a schiffli-shuttle guideway of an embroidering machine. In FIG. 4*b*, the reference numeral 44 designates a schiffli-shuttle guideway without a stitch or needle plate and turned 90 degrees in relation to FIG. 4*a*. In FIG. 4*c*, the reference numeral 45 designates the widened shuttle guideway leg of the schiffli-shuttle guideway 44, which has two bores or openings for accommodating shafts or rods 47 and 59.

The shuttle guideway leg 45 has a further bore for receiving a thread catch rod 46 instead of a knife or cutter. The not particularly shown knife or cutter is connected with the upper part of the bend of the adjacent schiffli-shuttle guideway leg 45. This allows increasing the pick-up or embroidering reinitiation length from 30 mm to 50 mm.

On a grooved, non-rotatable driver shaft or rod 47 a sliding, non-rotatable ring 48 is provided which is connected to an adjacent entrainment shaft or rod 59. At the head or top portion of the ring 48 a groove is provided, in which a claw or engagement means of a superior element is in fixed engagement. Furthermore, a spacer guide rod 49 is mounted at the schiffli-shuttle guideway 45 leg. A guide sleeve 30 is non-rotatably guided within the groove of the driver shaft or rod 47 through the ring 48 and laterally carries a stationarily bolted lower shuttle driver 36.

The guide sleeve 50 has a groove at its upper or top portion, into which a shuttle driver sleeve 51 of the driver shaft or rod 47 engages. The reference numeral 52 designates a projection on the shuttle driver sleeve 51. This projection 52 actuates a thread catch pivot arm connected with a thread catch 46 when the guide sleeve 51 is rotated. The guide sleeve 51 has an additional projection 53 which, on rotation of the guide sleeve 51, strikes a stop 54 and prevents the guide sleeve 51 from sliding back down when in its rotated position.

An extension of the shuttle guideway mounting plate fixture forms an upper shuttle driver or slider 55 mounted at the head end of the guide sleeve 51. If the guide sleeve 51 is rotated, the upper shuttle driver 55 lifts automatically in the manner of a barrier or toll gate in dependence of the program and releases the schiffli-shuttle for removal. The upper shuttle driver 55, which can be lifted in the idle machine, can be removed manually from the running machine at any 4/4 embroidering station (cf. reference numeral 56) in order to, for instance, repair a schiffli-shuttle thread break; afterwards the upper shuttle driver 55 is reinserted manually in the running machine.

A pinion 57 is rotatably mounted on the guide sleeve 51. This rotating pinion 57 rotates the guide sleeve 51. The pinion 57 engages another pinion 58 on an adjacent entrainment shaft or rod 59 and is rigidly connected therewith. The entrainment rod 59 is also grooved and rotatably arranged and is operated by a shift lever 60.

Underneath the shift lever 60, an annular permanent magnet 61 is provided, which guides sleeve 62 when pivoted by lever 60.

The two separately arranged follower tabs or entrainment means 63 firmly connected to the sleeve or entrainment coupling 62 guide the schiffli-shuttle 7 between upper shuttle driver 55 and lower shuttle driver 36 during upward and downward movement. If, by means of the shift lever 60, the entrainment rod 59 is rotated, the corresponding selected schiffli-shuttle 7 is completely disengaged from the running centralized drive means, for instance from a reciprocating drive rail 64, of the entire machine at top dead center. The central drive or drive rail 64 may be a rectangular bar, which is an alternative to the conventional driver beam hitherto employed but occupies the same position and has the same fixed connection to the reciprocating motion of the unaltered schiffli-shuttle drive.

The rear carriage with its supports carries a stable supporting rack 65 for conjoint motion mounted at location 66. The rack 65 is used for carrying a variable control or selection plate 67, which is adjustable in height in repeat line increments either manually or by means of a stepping motor. The control or selection plate 67 is provided with chain links, cams or similar elements 68 for determining the repeat configuration. These elements 68 correspond in their dimensions to the engagement to and disengagement from the central drive means or drive rail 64. If the rear carriage of the embroidering machine is moved backwards by hand or by push button actuation, then the supporting rack 65 with the control or selection plate 67 is disengaged from the shift lever 60. Then the control or selection plate 67 is adjusted in height according to the desired repeat line. Finally the rear carriage returns into its working or operative position.

The embodiment described employing a magnetic rail for schiffli-shuttle changing produces no magnetic charge in the schiffli-shuttles 7 due to the very brief activation interval.

While there are shown and described present preferred embodiments of the invention, it is to be distinctly understood that the invention is not limited thereto, but may be otherwise variously embodied and practiced within the scope of the following claims.

What I claim is:

1. An apparatus for selectively driving schiffli-shuttles in embroidering stations of an embroidering machine, comprising:

at least one schiffli-shuttle guideway fixed to a frame member of the embroidering machine to extend in a predetermined direction of extent;

a schiffli-shuttle guided in each said at least one schiffli-shuttle guideway;

stationary longitudinal guide means fixed to said frame member and extending substantially parallel to said predetermined direction of extent of said schiffli-shuttle guideway;

a shuttle driver translatably guided by said stationary longitudinal guide means and provided with coupling means;

barrier means mounted at said shuttle driver and extending substantially transversely into said at least one schiffli-shuttle guideway for entraining and restraining said schiffli-shuttle in said schiffli-shuttle guideway;

rotatable longitudinal guide means journaled in said frame member;

an entrainment coupling translatably guided by said rotatable longitudinal guide means and provided with at least one entrainment means;

means for preventing rotation of said entrainment coupling in relation to said rotatable longitudinal guide means;

said rotatable longitudinal guide means having a first angular orientation in which said coupling means engages said at least one entrainment means and a second angular orientation in which said coupling means disengages from said at least one entrainment means;

a reciprocating drive member engaging said at least one entrainment means for transmitting drive motion through said entrainment coupling and said shuttle driver to said schiffli-shuttle; and control means for selectively rotating said rotatable longitudinal guide means between said first angular orientation and said second angular orientation.

2. The apparatus as defined in claim 1, further including:

drive means for driving said reciprocating drive member;

said drive means comprising an eccentric and a connecting rod;

a shaft carrying a toothed pulley cooperating with said connecting rod;

a toothed belt engaging said toothed pulley;

said toothed belt carrying said reciprocating drive member; and said eccentric driving said toothed belt via said shaft and said toothed pulley.

3. The apparatus as defined in claim 1, wherein:

said barrier means comprises a fixed lower shuttle driver;

said barrier means comprising an upper shuttle driver constructed as a rotatable barrier for said schiffli-shuttle;

said stationary longitudinal guide means being arranged substantially parallel to said at least one schiffli-shuttle guideway; and said shuttle driver accommodating said lower shuttle driver and said upper shuttle driver.

4. The apparatus as defined in claim 1, further including:

a rack and pinion drive connection; and said rotatable longitudinal guide means being constructed to be rotatable by said control means through said rack and pinion drive connection.

5. The apparatus as defined in claim 4, further including:

a hand wheel for manually rotating said rotatable longitudinal guide means independently of said control means.

6. The apparatus as defined in claim 1, wherein:

said control means comprises a pin roll having a peripheral surface and pins arranged upon said peripheral surface; and said pins being disposed according to the embroidering station to be activated.

7. The apparatus as defined in claim 1, wherein:

said reciprocating drive member is constructed as a rail bridging a plurality of embroidering stations.

8. The apparatus as defined in claim 1, wherein:

said control means comprises a selection control plate; and said selection control plate being vertically adjustable in accordance with a desired repeat line.

9. The apparatus as defined in claim 1, wherein:

said control means comprises a selection control pin roll.

* * * * *